US005420677A

United States Patent [19]

Gross et al.

[11] Patent Number: 5,420,677

[45] Date of Patent: May 30, 1995

[54] METHOD AND APPARATUS FOR EXTENDING MATERIAL LIFE IN A BIAS TRANSFER ROLL

[75] Inventors: Robert A. Gross; Kenneth W. Pietrowski, both of Penfield, N.Y.

[73] Assignee: Xerox Corporation, Stamford, Conn.

[21] Appl. No.: 789,506

[22] Filed: Nov. 8, 1991

[51] Int. Cl.[6] ..... G03G 15/14

[52] U.S. Cl. ..... 355/277; 355/275; 361/225

[58] Field of Search ..... 355/271, 277, 219, 275, 355/274; 252/500; 430/902; 361/212, 225, 229

[56] References Cited

U.S. PATENT DOCUMENTS 3,626,260 12/1971 Kimura et al. ..... 361/225
3,847,478 11/1974 Young ..... 355/274
4,062,812 12/1977 Safford et al. ..... 252/500
4,116,894 9/1978 Lentz et al. ..... 430/56
4,380,384 4/1983 Ueno et al. ..... 355/219
4,977,430 12/1990 Florack et al. ..... 355/274
5,006,902 4/1991 Araya ..... 355/271

*Primary Examiner*—Robert B. Beatty
*Assistant Examiner*—Shuk Y. Lee
*Attorney, Agent, or Firm*—Denis A. Robitaille

[57] ABSTRACT

A method and apparatus for extending the electrical life of a bias transfer roll is disclosed. The apparatus includes a biasing member comprising a bias roll member or other charging device for reversing current flow through the bias transfer roll. The apparatus of the present invention permits reversal of current flow through a bias transfer roll to replenish ions depleted therefrom during the transfer process.

39 Claims, 3 Drawing Sheets

METHOD AND APPARATUS FOR EXTENDING MATERIAL LIFE IN A BIAS TRANSFER ROLL

The present invention relates generally to a system for transfer of charged toner particles in an electrostatographic printing apparatus, and more particularly concerns a method and apparatus for extending the electrical life of an electrically biased transfer member by enabling reverse current flow therethrough.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface thereof. The developing material is then transferred from the photoreceptive member to a copy sheet or other support substrate to create an image which may be permanently affixed to the copy sheet, providing a reproduction of the original document. In a final step, the photoconductive surface of the photoreceptive member is cleaned to remove any residual developing material thereon in preparation for successive imaging cycles.

The described electrostatographic copying process is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The process of transferring developing material from the photoreceptive member to the copy sheet is realized at a transfer station. In a conventional transfer station, transfer is commonly achieved by applying electrostatic force fields in a transfer nip sufficient to overcome forces which hold the toner particles to its original support surface on the photoreceptive member. These electrostatic force fields operate to attract and transfer the toner particles over onto the copy sheet or other supporting second surface.

Historically, transfer of toner images between support surfaces in electrostatographic applications is accomplished via electrostatic induction using a corotron or other corona generating device. In corona induced transfer systems, the final support sheet is placed in direct contact with the toner image while the image is supported on the photoconductive surface. Transfer is induced by spraying the back of the support sheet with a corona discharge having a polarity opposite that of the toner particles, thereby electrostatically transferring the toner particles to the sheet. An exemplary corotron ion emission transfer system is disclosed in U.S. Pat. No. 2,807,233.

More recently, biased roll transfer systems have been used successfully to accomplish toner transfer, providing a means for controlling the magnetic and non-magnetic forces acting on the toner during transfer. This type of transfer was first disclosed by Fitch in U.S. Pat. No. 2,807,233 which disclosed the use of a metal roll coated with a resilient coating having an approximate resistivity between 106 and 108 ohm-cm. The resistivity of the coating provides a limit to the amount of bias that can be applied to the roll due to the fact that, at higher ranges, the air in and about the transfer zone begins to break down, or "ionizes", causing the image to degrade during transfer. Nonetheless, bias roll transfer has become the transfer method of choice in state-of-the-art xerographic copying systems and apparatus. Notable examples of biased roll transfer systems are described in U.S. Pat. No. 3,702,482 by C. Dolcimascolo et al., and U.S. Pat. No. 3,781,105, issued to T. Meagher. Other general examples of biased roll transfer systems can be found in U.S. Pat. Nos. 2,807,233; 3,043,684; 3,267,840; 3,328,193; 3,598,580; 3,625,146; 3,630,591; 3,684,364; 3,691,993; 3,832,055; and 3,847,478.

In summary, the transfer of development materials in an electrostatographic process involves the physical detachment and transfer-over of charged particulate toner materials from one surface into attachment with a second surface by electrostatic force fields. The critical aspect of the transfer process focuses on maintaining the same pattern and intensity of electrostatic fields as the original latent electrostatic image being reproduced to induce transfer without scattering or smearing of the developer material. This difficult requirement is met by careful control of the electrostatic fields which, by necessity, must be high enough to effect toner transfer while being low enough so as not to cause arcing or excessive ionization at undesired locations. Such electrical disturbances can create copy or print defects by inhibiting toner transfer or by inducing uncontrolled transfer of the development materials.

The problems associated with successful image transfer are well known. In the pre-transfer or so called pre-nip region, immediately in advance of copy sheet contact with the image, excessively high transfer fields can result in premature transfer across the air gap, leading to decreased resolution or blurred images. High transfer fields in the pre-nip air gap can also cause ionization which may lead to strobing or other image defects, loss of transfer efficiency, and a lower latitude of system operating parameters. Conversely, in the post-transfer or so called post-nip region, at the photoconductor/copy sheet separation area, insufficient transfer fields can cause image dropout and generate hollow characters. Improper ionization in the post-nip region may also cause image stability defects or create copy sheet detacking problems. Inducing variations in desirable field strength across the transfer region must be balanced against the basic premise that the transfer field should be as large as possible in the region directly adjacent the transfer nip where the copy paper contacts the image so that high transfer efficiency and stable transfer can be achieved.

Variations in ambient environment conditions, copy paper resistivity, contaminants, and field strength, can all effect necessary transfer parameters. Material resistivity can change greatly with humidity and other environmental parameters. Further, in bias transfer roll systems, conduction of the bias charge from the bias transfer roll is greatly affected by the magnitude of transfer current through the bias roll material. The functional life of the bias transfer roll is directly related to the maintenance of a constant controlled resistivity region through which the transfer current flows.

It has been shown that charge control additives such as organic salts and specifically tetrahepthlammonium bromide (THAB) can be used in bias transfer system components to attain specific resistivity levels. However, as transfer current flows through the biased transfer member, the charge control additives in the base material migrate, depleting ions and increasing the resistivity of the material causing the bias voltage to increase while maintaining a constant transfer current. The prenip fields correspondingly increase, generating severe copy quality problems. The hardware design is also complicated because of the higher voltages involved. Thus, the material used in the fabrication of a typical bias transfer roll has an intrinsic electrical life directly related to the ionic depletion of charge control additives in the base material. The problem associated with bias transfer roll systems is that the electrical life of the bias roll material is inversely proportional to the transfer current therethrough.

Various approaches and solutions to the problems inherent to the use of bias transfer rolls and specifically directed toward extending the electrical life thereof have been proposed. The following disclosures may be relevant to various aspects of the present invention:

U.S. Pat. No. 3,847,478

Patentee: Young

Issued: Nov. 12, 1974

U.S. Pat. No. 4,062,812

Patentee: Safford et al.

Issued: Dec. 13, 1977

U.S. Pat. No. 4,116,894

Patentee: Lentz et al.

Issued: Sep. 26, 1978

The relevant portions of the foregoing disclosures may be briefly summarized as follows:

U.S. Pat. No. 3,847,478 discloses a segmented bias roll for use in a xerographic transfer system for simultaneous single pass duplex copying. The bias transfer roll of that patent is provided with multiple, discrete conductive segments wherein the transfer bias potential is applied, through a sliding contact, to only the conductive segments in the transfer nip area. This bias roll system includes a conventional xerographic cleaning brush pivotally mounted for rotational sweeping engagement with the surface of the bias roll.

U.S. Pat. No. 4,062,812 discloses a method for extending the electrical life of copolymers used in bias transfer rolls. That patent recognizes that control of, and minimization of the variations in the resistivity under applied voltages with respect to time is important. Thus, certain salts having a particular geometric make-up which are useful for extending the functional electrical life and electrical stability of materials are incorporated into the materials used in xerographic devices.

U.S. Pat. No. 4,116,894 also discloses compositions and a method for enhancing the electrical life of copolymers used in xerographic devices. That patent discloses a specific method for enhancing the electrical life of butadiene copolymers having solubilized conductivity control agents incorporated therein by varying specified quantities of terminally unsaturated hydrocarboned nitriles in the butadiene.

In accordance with the present invention, a transfer apparatus for electrostatically transferring charged toner particles from a photoconductive image support surface to a copy support substrate is disclosed, comprising a transfer member connected to electrical biasing means for attracting toner particles from an image support surface to a copy support substrate and means for enabling reverse current flow through the bias roll material to replenish ions depleted therefrom during toner transfer, thereby extending the electrical life of the biased transfer means. The means for producing this reverse current flow include one or more known devices, such as a biased roll member, a biased contact brush, or a biased blade and may include other known corona generating devices such as a corotron or scorotron.

In another aspect of the invention, an electrostatographic printing apparatus is disclosed, including a transfer assembly for transferring toner particles from a photoconductive image support surface to a copy support substrate, wherein the transfer assembly includes a bias transfer roll coupled to an electrical biasing means and a current source for enabling reverse current flow through the bias transfer roll.

Yet another aspect of the present invention provides a method for extending the life of an electrically biased transfer roll in an electrostatographic printing apparatus, comprising the step of reversing current flow through a bias transfer roll so as to replenish the bias transfer roll with ions depleted therefrom during the transfer process.

These and other aspects of the present invention will become apparent from the following description in conjunction with the accompanying drawings, in which.

Figure 1:
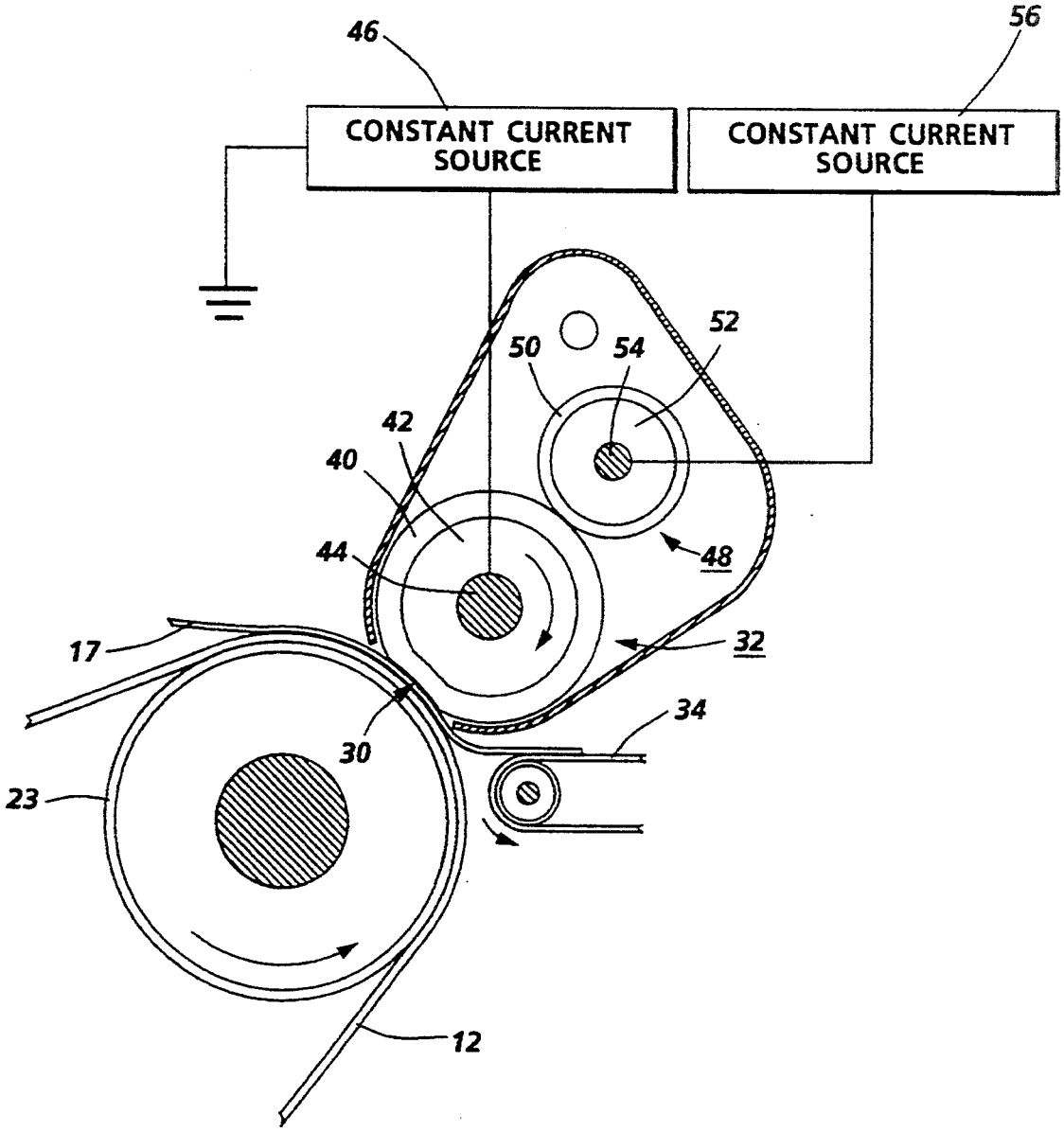
FIG. 1 is a side view of one preferred embodiment of the transfer assembly of the present invention showing the bias transfer roll and the bias roll member used for reversing current flow through the bias transfer roll.

While the present invention will be described with reference to preferred embodiments thereof, it will understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds wherein like reference numerals have been used throughout to designate identical elements.

Figure 3:
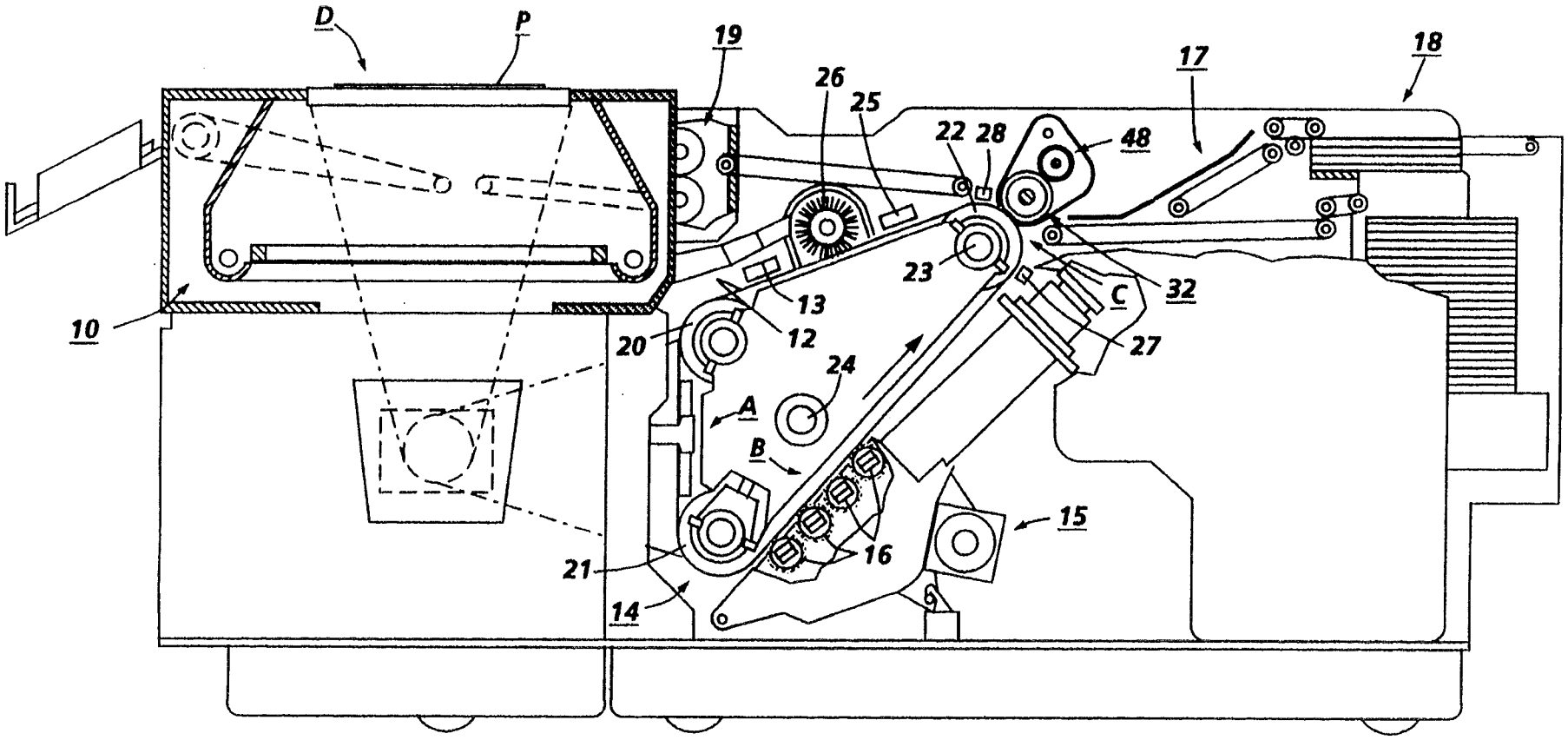
FIG. 3 is a schematic elevational view showing an electrostatographic printing machine employing the features of the present invention.

For a general understanding of an electrostatographic printing machine in which the features of the present invention may be incorporated, reference is made to FIG. 3, which schematically depicts the various components thereof. It will become apparent from the following discussion that the transfer assembly of the present invention is equally well suited for use in a wide variety of electroreprographic machines, as well as a variety printing, duplicating and facsimile devices.

Referring now to FIG. 3, before describing the specific features of the present invention, a schematic depiction of the various components of an exemplary electrophotographic printing apparatus incorporating the transfer assembly of the present invention is provided. Preferably, the electrophotographic copying apparatus employs a belt 12 having a photoconductive layer deposited on an electrically grounded conductive substrate. Belt 12 is entrained about rollers 20, 21 and 22 wherein roller 22 is rotatably supported on shaft 23 and is rotatably driven by a suitable motor and drive assembly (not shown). Roller 22 engages with the belt 12 to induce travel thereof in the indicated process direction about a curvilinear path defined by rotatably mounted rollers 20, 21 and 22. Preferably, belt 12 has the general characteristics disclosed in U.S. Pat. No. 4,265,990, the contents of which are hereby incorporated by reference, wherein the photoconductive surface of belt 12 includes a selenium alloy providing an imaging medium while the conductive substrate thereof comprises an aluminum alloy.

Production of an electrophotographic reproduction of an original document is carried out as follows: An input document D is placed upon a transparent support platen P as an integral component in an illumination assembly, generally indicated by reference numeral 10. Light is projected from the illumination assembly 10 onto the original document D to produce an optical image corresponding to the informational areas on the document D. This optical image is projected by means of an optical system onto the photosensitive surface of belt 12 at exposure station A, thereby selectively dissipating the charge thereon to record an electrostatic latent image onto belt 12, corresponding to original document D.

After the electrostatic latent image is recorded on the photoconductive surface of belt 12, the belt 12 advances to development station B where a magnetic brush development system, indicated generally be reference numeral 15, deposits a developing material onto the electrostatic latent image. Preferably, a multiple magnetic brush development system is utilized wherein multiple brushes 16 are disposed within a developer housing to transport developing material comprising toner particles and carrier beads into contact with the electrostatic latent image on the photoconductive surface of belt 12. The electrostatic latent image attracts the toner particles away from the carrier beads of the developing material, forming a developed toner powder image on the photoconductive surface of belt 12.

The developed toner image is subsequently transported via belt 12 to transfer station C where an output copy sheet 17 is removed from a supply tray and transported into contact with the toner powder image on belt 12 by means of a paper handling mechanism, generally indicated by reference numeral 18. Each output copy sheet 17 is sequentially advanced into contact with belt 12 in synchronism with the developed image thereon so that the developed image contacts the advancing output copy sheet 17 at transfer station C at the appropriate time. The bias transfer roll assembly of the present invention is provided at transfer station C for establishing a directional force field capable of attracting toner particles from the photoconductive surface of belt 12 toward the bias transfer roll, thereby effecting transfer of the toner particles to the copy sheet 17. The bias transfer roll assembly will be discussed in detail below.

After the transfer process is complete, the output copy sheet 17 having a developed toner image thereon, is stripped from belt 12 and conveyed into a fuser assembly, generally indicated by reference numeral 19. The fusing roll assembly affixes the transferred toner powder image onto the output copy sheet 17. The fuser roll assembly 19 preferably comprises a heated fuser roller and a support roller spaced closely adjacent one another for receiving the output copy sheet 17 therebetween. The toner image is thereby forced into contact with the fuser roll to permanently affix the toner image to the output copy sheet 17.

After fusing, the finished copy is discharged to an output tray (not shown) for subsequent removal of the output copy by an operator. A final processing station, namely a cleaning station, preferably comprising corona generating devices 13, 25 and cleaning brush 26, is provided for removing residual toner particles from the photoconductive surface of belt 12 after the output copy sheet is stripped from belt 12. The cleaning station may also include a blade (not shown), adjustably mounted for physical contact with the photoconductive surface of belt 12 to remove toner particles therefrom. Further, the cleaning station may also include a discharge lamp (not shown) for flooding the photoconductive surface of belt 12 with light to dissipate any residual electrostatic charge remaining thereon in preparation for subsequent imaging cycles.

The foregoing description should be sufficient for the purposes of the present application for patent to illustrate the general operation of an electrophotographic copying apparatus incorporating the features of the present invention. As described, an electrophotographic copying apparatus may take the form of any of several well known devices or systems including an electrostatographic printing machine. Variations of specific electrostatographic processing subsystems or processes may be expected without affecting the operation of the present invention.

Referring now more particularly to FIG. 1, a particular embodiment of a bias transfer assembly in accordance with the present invention will be described. The use of the term "bias transfer roll" or "bias transfer assembly" refers to a transfer assembly having an electrically biased member for cooperating with an image support surface to attract electrically charged particles from the image support surface onto a second support surface such as a copy support substrate. Specifically, a bias transfer assembly including a bias transfer roll is shown in FIG. 1, wherein the bias transfer roll 32 is shown in a configuration which allows the roll 32 to cooperate with the toner image on the photoconductive surface of belt 12 when brought into contact therewith. The bias transfer roll 32 attracts charged toner particles from the photoconductive surface in the direction of the bias transfer roll 32 so as to transfer the developed images on the photoconductive surface from the belt 12 to a final support material such as copy paper or the like.

With respect to FIG. 1, an exemplary transfer assembly including a bias transfer roll representative of the specific subject matter of the present invention is illustrated. The primary components of the transfer assembly of the present invention are transfer roll 32 spaced adjacent backup roll 23 forming a nip 30 therebetween, and bias member 48 spaced adjacent transfer roll 32 and positioned substantially opposite the nip 30. For the purposes of the present discussion, backup roller 23 is the drive roll previously described hereinabove with respect to FIG. 3 which is coupled to a drive motor (not shown). It will be understood, however, that the backup roll 23 may be an independent roll positioned along the photoconductive belt 12, provided for urging the belt 12 into contact with the transfer roll 32. Alternatively, it will be understood by those of skill in the art that a belt configuration could be utilized in which no backup roll or opposing support member is required.

The transfer roll 32 is appropriately journaled for rotation at an angular velocity such that the peripheral speed of the roll 32 is substantially equal to the speed of the belt 12. A copy support substrate 17 is fed by appropriate means, such as conveyor 34, into the nip 30 formed between transfer roll 32 and backup roll 23. The arrows shown in FIG. 1 indicate the relative direction of movement for the respective roll members 23, 32, the respective belts 12, 34 and the copy support sheet 17. As such, the terms "pre-nip" and "post-nip" used herein, refer to the direction of travel of the transfer sheet 17 through the transfer nip 30.

The exemplary transfer roll 32 of the present invention includes an electrically "self-leveling" outer layer 413, an electrically "relaxable" inner layer 42 on a central conductive core or axle 44. A constant current electrical bias or energy source 46 is electrically connected to this conductive core 44. The relaxable layer 42 has a bulk resistivity falling in a well-defined operating range selected relative to the transfer roll 32 diameter and the surface velocity thereof. The preferred resistivity ranges may vary for transfer systems designed to operate at different transfer sheet throughput speeds. The relative deformable characteristics of the relaxable layer 42 allow for good mechanical contact in the transfer zone of the transfer nip 30, at moderate pressures to eliminate "hollow character" transfer under normal operating conditions. Moreover, by providing a relaxation time in the core material which is great compared to ion transfer time in a gaseous environment, the transfer roll 32 acts as an insulator to protect against arcing and further controlling the amount of charge transferred at any point on the surface.

In a preferred embodiment, the relaxable layer 42 comprises a relatively thick blanket of a resilient elastomeric polyurethane material, which may comprise a butadiene based copolymer having a hardness of between about 40 Shore 00 and about 90 Shore A. This elastomeric polyurethane blanket may be about 0.030 to about 0.625 inches in thickness (preferably 0.25 inches in thickness), having sufficient resiliency to allow the bias transfer roll 32 to deform when brought into moving contact with the photoconductive surface of belt 12. This deformable feature provides an extended contact region in which the toner particles of the developer material can be transferred between support surfaces. It will be understood by those of skill in the art that the deformable feature created by relaxable layer 42 is not a necessary feature of the present invention, as for example in a configuration wherein transfer is conducted against an unsupported portion of the photoconductive belt 12.

The material of the relaxable layer 42 is further selected so that it functionally takes a selected time period to transmit a charge from the conductive core 44 to the interface between the relaxable layer 42 and the self-leveling layer 40. This selected time period corresponds to the roller surface speed and nip region width such that the time necessary to transmit a charge from the conductive core 44 to the self-leveling layer 40 is roughly greater than the time period that any point on the transfer roll 32 is in the nip region. Ideally, the external voltage profile of the bias transfer roll provides a field strength below that for substantial air ionization in the air gap at the entrance of the nip and a field strength above that recorded for air ionization in the air gap just beyond the exit of the nip. As a general rule, this time period is approximately equal to $\frac{1}{4}$ of the roll revolution time so that the magnitude of the external electric field increases significantly from the pre-nip entrance toward the post nip exit, while the field within the relaxable layer 42 diminishes. It has been found that a resistivity of between about $10^7$ and $5.0\times10^{11}$ ohm-cm, and preferably a resistivity of about $10^8$ to about $10^{10}$ ohm-cm is sufficient for this requirement.

The transfer roll 32 is covered with a relatively thin outer coating or so called self-leveling layer 40, which may comprise an elastomeric material such as polyurethane having a resistivity of between $10^{10}$ and $10^{15}$ ohm-cm, preferably having a thickness of approximately 0.0025 inches and a hardness of about 65 to 75 Durometer. This self-leveling layer comprises a leaky insulator, generally selected for its higher resistive values. In addition, the self-leveling layer includes material (or is so related to the relaxable layer), so that charges applied to the outer surface of the self-leveling layer 40 will be generally dissipated within one revolution of the transfer roll 32 in order to prevent suppression of the transfer field in the transfer nip 30. The self-leveling layer also acts as a thin insulating layer to protect the bias transfer roll during air breakdown, to act as a moisture barrier, to limit current flow through the roll 32 and to make the roll surface easy to clean. It will be noted, however, that materials have been used to form the relaxable layer 42 which are resilient, durable and cleanable such that the self-leveling layer 40 described herein is not essential.

A constant current source 46 is provided for applying an electrical potential to the bias transfer roll 32. The constant current energy (bias) source 46 provides current control for maintaining pre-nip ionization at tolerable levels while allowing a desired amount of post-nip ionization and maintaining a high transfer field. A discussion of the electric fields developed by the bias transfer roll 32 and the roles of the relaxable and self-leveling layers, as well as a detailed description of a preferable bias circuit are provided in U.S. Pat. No. 3,781,105, issued to Meagher, the contents of which are hereby incorporated by reference.

Other bias transfer members are described by Eddy et al. in U.S. Pat. No. 3,959,573, also incorporated herein by reference, where there is described and claimed biasable transfer members having a coating of a hydrophobic elastomeric polyurethane and having a resistivity in which the change in resistivity is substantially insensitive to changes in relative humidity. Disclosed therein is the use of ionic additives for reducing the resistivity of the hydrophobic elastomeric polyurethane. Examples of the ionic additives include organic salts and quaternary ammonium compounds exemplary of which are tetraheptyl ammonium compounds. Further, Seanor et al. in U.S. Pat. No. 3,959,574, also incorporated herein by reference, describe and claim biasable transfer members comprising a conductive substrate and at least one coating of an elastomeric polyurethane having an additive therein for controlling the resistivity of the polyurethane, the coating being placed over the conductive substrate. Exemplary of the additives therein which provide a method and composition for controlling the resistivity of a biasable transfer members, are the quaternary ammonium compounds, and in particular: tetrahepthlamonnium bromide; tetraheptyl ammonium bromide; trimethyloctadecyl ammonium chloride; and benzyltrimethyl ammonium chloride.

Although the foregoing references provide polyurethane materials which have many desirable electrical and physical characteristics, the functional life of a component, such as a bias transfer roll, is directly related to the maintenance of a constant controlled resistivity region. The copolymerization of butadiene and a terminally unsaturated hydrocarbon nitrile which selectively introduces nitrile groups into the polymer, greatly enhances the ionization of ionic additives, e.g., quaternary ammonium, resulting in the need for lower additive molalities and resulting in improved materials stability and solubility. However, many ionic additives increase ionic mobility and therefore result in a more rapid variation in the resistivity over the life of the material. It is also important to control the conductivity or electrical relaxation behavior (ionic mobility versus equilibrium rate between ionized and un-ionized salt so that new ions are provided as electrolysis depletes existing ions) of the polymers used in the foregoing devices where concurrent demands for moisture insensitivity, mechanical durability and systems stability are also important.

It is known that electrical life of additive materials used in transfer devices and subsystems as described above can be improved by controlling (constant) resistivity with time under an applied electrical field. Thus, it has been found by the present invention, that electrical life of transfer rolls having ionic additives can be improved by exposing the bias transfer roll to a reverse current flow for offsetting the ion depletion from the transfer roll material during the image transfer process. For this reason, the present invention provides a bias source positioned substantially adjacent the transfer roll for reversing current flow therethrough.

An exemplary bias source is shown in FIG. 1, as bias roll member 48. Bias roll member 48 may include an electrically self-leveling outer layer 50 and an electrically relaxable inner layer 52 on a conductive core 54, similar to bias transfer roll 32. Alternatively, bias roll member 48 may include an electrically conductive brush element. A constant current electrical bias or energy source 56 is electrically connected to the conductive core 54 for providing a biasing potential thereto. In the exemplary embodiment shown, a biasing voltage of between 1 Kv–8Kv is applied to bias transfer roll 32, while a biasing voltage of between 1.5 Kv–10Kv is applied to bias roll member 48. Thus, a differential voltage of between 500 and 8 Kv is applied to generate a field strength between 5 v/micron–64 v/micron for creating efficient reverse current flow to provide substantially infinite electrical life to the bias transfer roll 32. As in the case of the bias transfer roll 32, the bulk resistivity of the overall bias roll member 48 falls in a well-defined operating range relative to the specific characteristics and profile of the bias transfer roll 32. The bias roll member of the present invention produces a charge for injecting ions into the surface of the bias transfer roll. In addition, by providing for contact between the bias roll member 48 and the bias transfer roll 32, the bias roll member can be used as a cleaning device for cleaning residual toner particles from the bias transfer roll surface.

Figure 2:
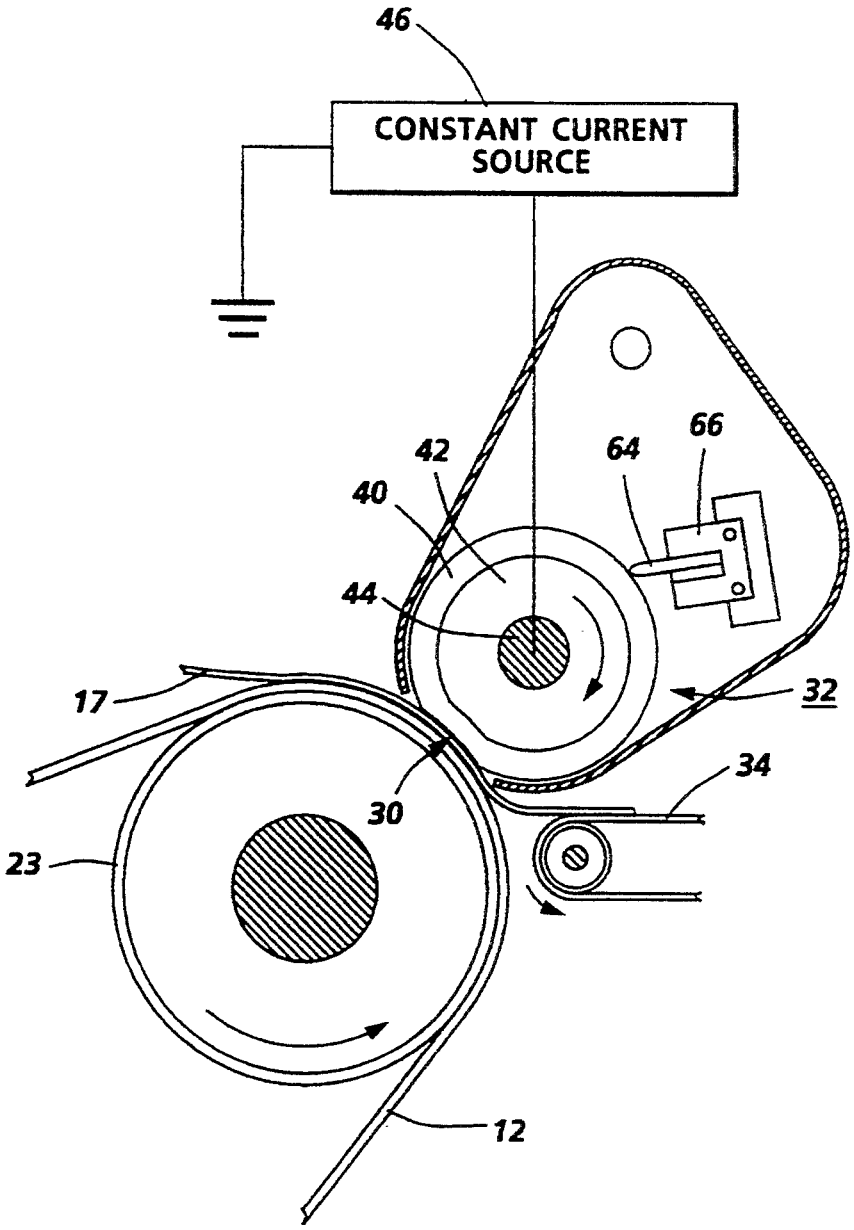
FIG. 2 is a side view of an alternative embodiment of the present invention.

An alternative embodiment of the biased transfer apparatus of the present invention is shown in FIG. 2, wherein there is provided a device for reversing current flow through the bias transfer roll 32 comprising an arcuately tipped electrically conductive blade 64 juxtaposed adjacent to the bias transfer roll 32. Blade 64 provides means for applying a bias field from a constant current source (not shown) between the electrically conductive blade 64 and the bias transfer roll 32. This biasing field enables reverse current flow from the bias transfer roll 32 toward the blade 64. In order to protect the bias transfer roll 32, blade 64 is provided with an arcuate-shaped head. It has been found that, by providing such arcuate-shaped head, small variations in the diameter of roll 32, are tolerable. Alternatively or additionally, blade 64 can be mounted in a cushioned support block 66 so that variations in the diameter of roll 32 can be compensated by motion of the blade 64 with respect to the roll 32.

It will be understood that alternative biasing means including corona discharge devices known in the art may also be provided for reversing current flow through the bias transfer roll 32.

In recapitulation, the electrophotographic printing apparatus of the present invention includes a toner transfer system having a bias transfer roll and a biasing member for reversing current flow through the bias transfer roll to replenish ions depleted therefrom during the transfer process. The biasing member can include various biased electrode systems as well as other known charging devices. The present invention provides for extended electrical life of the bias transfer roll in an electrophotographic printing apparatus.

It is, therefore, evident that there has been provided, in accordance with the present invention, an electrophotographic printing apparatus that fully satisfies the aims and advantages of the invention as hereinabove set forth. While this invention has been described in conjunction with a preferred embodiment thereof, it is evident that many alternatives, modifications, and variations will be apparent to those skilled in the art. Accordingly, the present application for patent is intended to embrace all such alternatives, modifications and variations as are within the broad scope and spirit of the appended claims.

We claim:

1. An apparatus for transferring toner from an image support surface to a copy substrate, comprising:

a transfer member including an ionic charge control additive, said transfer member being positioned adjacent said image support surface to define a nip therebetween for receiving said copy substrate;

means, connected to said transfer member, for electrically biasing said transfer member to generate current flow therethrough for attracting toner from said image surface to said copy substrate; and means, including an electrically biased member, positioned substantially adjacent said transfer member, for reversing said current flow therethrough to control migration and depletion of the ionic charge control additive such that substantially controlled resistivity is maintained in said transfer member.

2. The transfer apparatus of claim 1, wherein said current flow reversing means includes:

a bias roll member having an electrically conductive element; and an electrical bias source connected to said electrically conductive element for providing electrical current bias roll member to induce said reverse current flow through said transfer member.

3. The transfer apparatus of claim 2, wherein said electrical bias source includes a constant current energy source.

4. The transfer apparatus of claim 1, wherein said current flow reversing means includes an electrically conductive blade.

5. The transfer apparatus of claim 4, wherein said electrically conductive blade includes an arcuate tip end.

6. The transfer apparatus of claim 4, wherein said electrically conductive blade is mounted in a cushion support block.

7. The transfer apparatus of claim 1, wherein said current flow reversing means includes a bias brush.

8. The transfer apparatus of claim 1, wherein:

said image support surface includes a belt structure; and said transfer apparatus further includes a backup roll underlying said image support surface for providing support thereto.

9. The transfer apparatus of claim 1, wherein said transfer member includes a transfer roll having an electrically conductive core member.

10. The transfer apparatus of claim 9, wherein said transfer roll includes a first layer of resistive material surrounding said electrically conductive core member.

11. The transfer apparatus of claim 10, wherein said first layer of resistive material includes a relaxable elastomer.

12. The transfer apparatus of claim 10, wherein said first layer of resistive material includes the charge control additive.

13. The transfer apparatus of claim 12, wherein the charge control additive is an organic salt compound.

14. The transfer apparatus of claim 12, wherein the charge control additive is a quaternary ammonium compound selected from the group consisting of tetraheptyl ammonium bromide, trimethyloctadecyl ammonium chloride and benzyltrimethyl ammonium chloride.

15. The transfer apparatus of claim 10, wherein said transfer roll further includes a second layer of resistive material surrounding said first layer of resistive material for providing physical protection to said transfer roll.

16. The transfer apparatus of claim 15, wherein said second layer of resistive material includes a self-leveling elastomer.

17. The transfer apparatus of claim 15, wherein said second layer of resistive material includes the charge control additive.

18. The transfer apparatus of claim 17, wherein the charge control additive is an organic salt compound.

19. The transfer apparatus of claim 17, wherein the charge control additive is a quaternary ammonium compound selected from the group consisting of tetraheptyl ammonium bromide, trimethyloctadecyl ammonium chloride and benzyltrimethyl ammonium chloride.

20. An electrostatographic printing apparatus including a transfer assembly for transferring toner from an image support surface to a copy substrate, said transfer apparatus including a bias transfer roll including an ionic charge control additive and having a surface positioned adjacent said image support surface forming a nip therebetween for receiving said copy substrate, and electrical biasing means connected to said bias transfer roll for generating current flow therethrough to attract toner from said image surface onto said copy substrate, said transfer apparatus further including a system for extending electrical life of said bias transfer roll, comprising:

a bias member positioned substantially adjacent said bias transfer roll, said bias member being adapted to reverse said current flow through said bias transfer roll to control migration and depletion of the ionic charge control additive such that substantially controlled resistivity is maintained in said bias transfer roll.

21. The electrostatographic printing apparatus of claim 20, wherein said bias member includes:

a bias roll element having an electrically conductive core; and an electrical bias source connected to said electrically conductive core for providing electrical current through said bias roll element to induce said reverse current flow through said bias transfer roll.

22. The electrostatographic printing apparatus of claim 21, wherein said electrical bias source includes a constant current energy source.

23. The electrostatographic printing apparatus of claim 20, wherein said bias member includes an electrically conductive blade.

24. The electrostatographic printing apparatus of claim 23, wherein said electrically conductive blade includes an arcuate tip end.

25. The electrostatographic printing apparatus of claim 23, wherein said electrically conductive blade is mounted in a cushioned support block.

26. The electrostatographic printing apparatus of claim 20, wherein said bias member includes a bias brush.

27. The electrostatographic printing apparatus of claim 20, wherein:

said image support surface includes a belt structure; and said transfer apparatus further includes a backup roll underlying said image support surface for providing support thereto.

28. The electrostatographic printing apparatus of claim 20, wherein said bias transfer roll includes an electrically conductive core member.

29. The electrostatographic printing apparatus of claim 28, wherein said bias transfer roll further includes a first layer of resistive material surrounding said electrically conductive core member.

30. The electrostatographic printing apparatus of claim 29, wherein said first layer of resistive material includes a relaxable elastomer.

31. The electrostatographic printing apparatus of claim 29, wherein said first layer of resistive material includes the charge control additive.

32. The electrostatographic printing apparatus of claim 31, wherein the charge control additive is an organic salt compound.

33. The electrostatographic printing apparatus of claim 31, wherein the charge control additive is a quaternary ammonium compound selected from the group consisting of tetraheptyl ammonium bromide, trimethyloctadecyl ammonium chloride and benzyltrimethyl ammonium chloride.

34. The electrostatographic printing apparatus of claim 29, wherein said bias transfer roll further includes a second layer of resistive material surrounding said first layer of resistive material for providing physical protection to said bias transfer roll.

35. The electrostatographic printing apparatus of claim 34, wherein said second layer of resistive material includes a self-leveling elastomer.

36. The electrostatographic printing apparatus of claim 34, wherein said second layer of resistive material includes the charge control additive.

37. The electrostatographic printing apparatus of claim 36, wherein the charge control additive is an organic salt compound.

38. The electrostatographic printing apparatus of claim 36, wherein the charge control additive is a quaternary ammonium compound selected from the group consisting of tetraheptyl ammonium bromide, trimethyloctadecyl ammonium chloride and benzyltrimethyl ammonium chloride.

39. A method of extending electrical life of a bias transfer roll having ionic charge control additives therein said bias transfer roll being adapted to generate electrostatic fields to attract toner from an image support surface to a copy substrate, comprising the step of:

injecting ions onto said bias transfer roll to control migration and depletion of the ionic charge control additives such that substantially controlled resistivity is maintained in said bias transfer roll.

* * * * *